United States Patent [19]

Holtham et al.

[11] Patent Number: 4,628,828

[45] Date of Patent: Dec. 16, 1986

[54] ASH HANDLING SYSTEMS FOR COMBUSTION EQUIPMENT

[75] Inventors: Roy D. Holtham, Upton-on-Severn; Anthony J. Falconer, Tibberton; John F. G. Grainger, Tewkesbury, all of England

[73] Assignee: Coal Industry (Patents) Limited, England

[21] Appl. No.: 668,715

[22] Filed: Nov. 6, 1984

[30] Foreign Application Priority Data

Dec. 2, 1983 [GB] United Kingdom ..... 8332266

[51] Int. Cl.[4] ..... F23J 1/00

[52] U.S. Cl. ..... 110/165 R; 110/222; 110/228; 110/255; 222/413; 414/218; 198/550.1; 198/550.6

[58] Field of Search ..... 110/259, 255, 222, 227, 110/228, 165 R, 165 A, 170; 414/217, 218, 133, 213; 222/188, 319, 405, 413; 198/550.1, 550.6

[56] References Cited

U.S. PATENT DOCUMENTS

| | | | |
|---|---|---|---|
| 1,971,716 | 8/1934 | Hitchcock | 198/550.1 |
| 2,506,782 | 5/1950 | Fallon | 110/165 R |
| 3,146,918 | 9/1964 | Williams | 222/405 |
| 3,729,105 | 4/1973 | Huebler et al. | 414/218 |
| 3,771,643 | 11/1973 | Schmidth | 198/550.6 |
| 3,841,465 | 10/1974 | Miller, Jr. et al. | 414/218 |
| 3,863,577 | 2/1975 | Steever et al. | 110/255 |
| 3,951,081 | 4/1976 | Martin et al. | 110/222 |
| 4,009,667 | 3/1977 | Tyer et al. | 110/165 R |
| 4,041,906 | 8/1977 | Edwards | 110/222 |
| 4,057,978 | 11/1977 | Sato et al. | 110/165 R |
| 4,073,244 | 2/1978 | Snowdon | 110/165 R |
| 4,156,392 | 5/1979 | Bayeh | 110/228 |
| 4,203,374 | 5/1980 | Fredrick | 110/255 |
| 4,206,713 | 6/1980 | Ryason | 110/232 |
| 4,247,240 | 1/1981 | Schora, Jr. et al. | 414/218 |
| 4,267,801 | 5/1981 | Robinson | 110/165 R |
| 4,321,876 | 3/1982 | Mikus et al. | 110/165 R |
| 4,343,394 | 8/1982 | Emmert et al. | 198/550.6 |
| 4,426,018 | 1/1984 | Ward | 222/413 |
| 4,517,903 | 5/1985 | Richmond et al. | 110/233 |
| 4,561,596 | 12/1985 | Siwersson et al. | 222/413 |

FOREIGN PATENT DOCUMENTS

| | | |
|---|---|---|
| 2093585A | 9/1982 | United Kingdom . |
| 2093960A | 9/1982 | United Kingdom . |
| 2093961A | 9/1982 | United Kingdom . |

*Primary Examiner*—Henry C. Yuen

*Attorney, Agent, or Firm*—Stevens, Davis, Miller & Mosher

[57] ABSTRACT

An ash handling system includes a conveyor and crusher extending from an ash collection trough beneath an underfeed stoker retort to a hopper from which ash is discharged into an ash receiving zone of a container. A suction nozzle is used to extract ash from the zone for disposal.

14 Claims, 4 Drawing Figures

ASH HANDLING SYSTEMS FOR COMBUSTION EQUIPMENT

This invention concerns improvements in or relating to ash handling systems for combustion equipment.

One of the problems attendant upon the use of combustion equipment designed to burn solid fuel is that of the removal and disposal of solid residue (i.e., ash) from the combustion process. In conventional combustion equipment ash is normally allowed to gravitate from the combustion zone into a suitable receptacle which can be emptied periodically. In recent years, increasing emphasis has been placed upon the development of combustion equipment used both industrially and commercially with a view to conferring a high degree of amenity upon its operation in order to reduce the burden upon the user and thus to render solid fuel combustion equipment more attractive commercially, while containing costs within acceptable limits.

An object of the present invention is therefore to provide an ash handling system for solid fuel combustion equipment which will facilitate ash removal and disposal in the absence of any manual involvement.

A further object of the invention is to provide combustion equipment incorporating such an ash handling system.

A still further object of the invention is to provide a method of operating the combustion equipment incorporating the ash handling system.

According to a first aspect of the invention there is provided an ash handling system including a conveyor and crusher having an inlet region adapted to receive ash from combustion equipment and an outlet region for the discharge of ash, a hopper registering with the outlet region of the conveyor and crusher, a container enclosing the hopper and defining therein an ash receiving zone, and a pneumatic extraction means associated with the ash receiving zone.

The conveyor and crusher may advantageously be in the form of a screw provided with short robust flights and housed within a tube having an internal diameter not substantially greater than the diameter of the screw flights.

The conveyor and crusher may be orientated horizontally or in an inclined mode.

Conveniently the outlet region of the conveyor and crusher registers with an inlet of the hopper, the inlet being located at or near the base of the hopper, the outlet of the hopper being at or near the top thereof.

The hopper may be elevated within the container which may be provided with sloping side walls to define a trough-like configuration.

The pneumatic extraction means may include a suction nozzle extending into the ash receiving zone from the exterior of the container, the nozzle being connected to a vacuum generating unit incorporating an ash depository.

According to a second aspect of the invention there is provided combustion equipment including a housing defining a combustion zone therein, a combustion means located within the combustion zone, a conveyor and crusher having an inlet region disposed beneath the combustion means and adapted to receive ash therefrom and an outlet region for the discharge of ash, a hopper registering with the outlet region of the conveyor and crusher, a container enclosing the hopper and defining therein an ash receiving zone, and a pneumatic extraction means associated with the ash receiving zone.

The combustion means may be the retort of an underfeed stoker unit. In an alternative, the combustion means may comprise a grate.

According to a third aspect of the invention there is provided a method of operating the ash handling system and the combustion equipment of the first and second aspects wherein the method includes the steps of burning a solid fuel in the combustion means, allowing ash to discharge from the combustion means into the inlet region of the conveyor and crusher in which the ash is crushed and conveyed to the hopper, depositing ash from the hopper into the ash receiving zone of the container, and pneumatically extracting the ash from said zone.

By way of example only, one embodiment of an ash handling system, combustion equipment incorporating same and a method of operation therefor according to the invention are described below with reference to the accompanying drawings in which.

Figure 1:
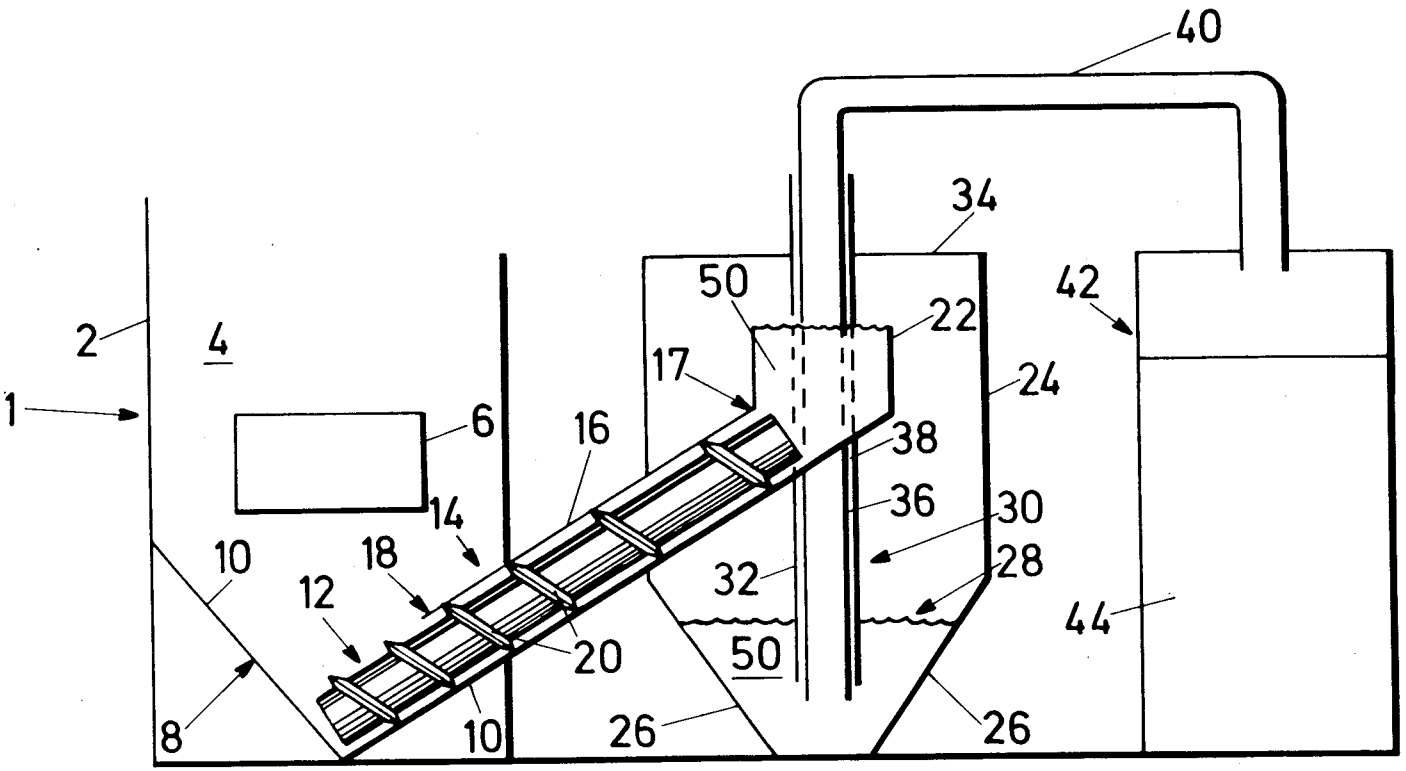
FIG. 1 is a diagrammatic illustration of the invention.

Referring to the drawings, there is shown combustion equipment 1 including a housing 2 defining a combustion zone 4 in which is located a retort 6 of an underfeed stoker, the remaining components of which have been omitted for the sake of clarity. An ash collection trough 8 is situated beneath the retort 6 and is provided with sloping side walls 10. A screw 12 of a conveyor and crusher 14 extends into the ash collection trough 8 and is inclined at a similar angle to that of the adjacent wall 10 of the trough 8. The screw 12 is housed for substantially the whole of its length within the trough 8 to provide an inlet region 18. The screw 12 has short robust flights 20 increasing in pitch from the inlet region 18 and is provided with a drive means (not shown) which may be common with that for the screw conveyor (not shown) of the underfeed stoker. The tube 16 terminates in an outlet region 17 and opens into the base of an open-topped hopper 22 which is disposed at an elevated level within a container 24, the base thereof having sloping walls 26 defining an ash receiving zone 28.

A suction nozzle is shown generally at 30 and includes an outer tube 32 which passes through the top 34 of container 24 and terminates within the ash receiving zone 28, and an inner tube 36 arranged concentrically within tube 32 defining an annular passage 38 therebetween. The inner tube 36 protrudes beyond the end of tube 32 and extends the whole length of tube 32 and terminates exteriorly thereof for connection to a conduit 40 leading to a vacuum generating device 42 provided with an ash depository 44.

In operation, solid fuel is burnt within the retort 6 to which the fuel is fed by a screw and ascends within the retort during combustion. Ash residue including any clinker is freely discharged over the lip (not shown) of the retort 6 and descends into the ash collection trough 8 from where it is conveyed and simultaneously crushed by the screw 12 of conveyor and crusher 14. The ash 50 is transported through the tube 16 from the inlet region 18 to the outlet region 17 and is discharged into the hopper 22 which gradually fills with ash. Once the firebed in the retort 6 has been established and the hopper 22 is full, an ash seal is created thereby preventing significant air leakage. The ash also experiences residence time in the hopper 22, thus affording a cooling period. Ash eventually discharges over the top of the hopper 22, which acts as a weir, and descends into the ash receiving zone 28. Upon activation of the vacuum generating device 42, air is induced through the annular passage 38 and entrains the crushed ash lying in the zone 28 along the tube 36 into conduit 40 which is advantageously provided with a smooth inner surface to reduce friction losses. The nozzle 30 may be vibrated during use to improve pick-up. The ash conveyed through conduit 40 is discharged into the depository 44 and is subsequently removed therefrom.

Figure 2:
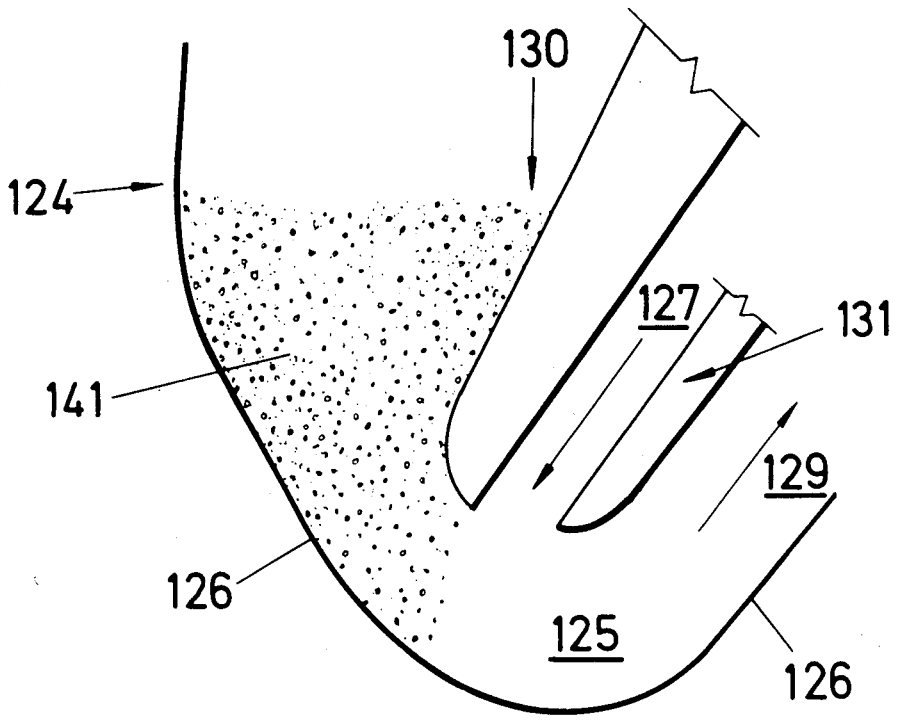
FIG. 2 is a diagrammatic sectioned view of an alternative form of a detail shown in FIG. 1.

In FIG. 2, there is shown an alternative form of nozzle referenced at 130 which is orientated adjacent a sloping wall 126 of the container 124. The nozzle 130 is spaced from the apex of the container 124 to define an entrainment zone 125 and comprises a rectangular-sectioned air passage 127 divided from a similarly sectioned suction passage 129 by a partition 131. The air passage 127 is open to atmosphere and the suction passage 129 is connected to a vacuum generating device (not shown). In use, the ash 141 is entrained in the zone 125 by the induced air flow which impinges on the particles. As can be seen the sharp change in direction of the air flow is of advantage in creating effective entrainment conditions.

Figure 3:
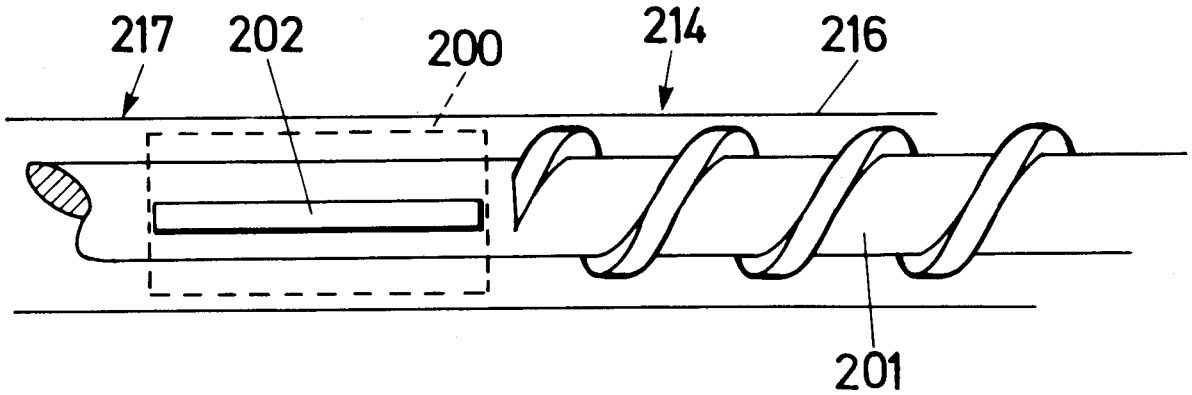
FIG. 3 is a fragmentary side view of an alternative of a detail shown in FIG. 1.
Figure 4:
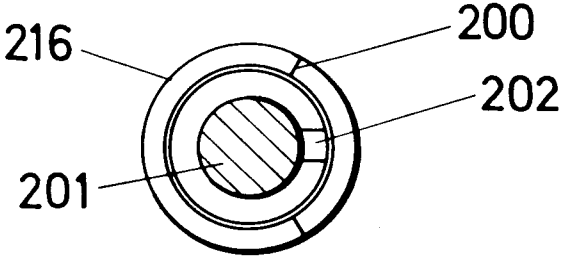
FIG. 4 is an end view of the detail shown in FIG. 3.

Referring now to FIGS. 3 and 4, an alternative form of discharge end 217 of the conveyor and crusher 214 is shown. A side discharge aperture 200 is provided in the discharge end 217 of casing 216 and in this region there is affixed to the shaft 201 of the screw 212 a length of bar 202 axially along the length of the shaft.

In use, the ash is crushed and conveyed by the conveyor and crusher 214 and upon reaching the aperture 200 is forced therethrough by the bar 202, thereby to be discharged into the hopper (not shown in FIGS. 3 and 4).

The present invention thus affords a means whereby ash created as a result of combustion can be disposed of effectively, cleanly and automatically.

It is envisaged that the container 24 will be of sufficient capacity to enable operations of the suction nozzle only once or twice a day in order to clear the total ash produced by the underfeed stoker combustion even at full output condition.

We claim:

1. An ash handling system for use with combustion equipment including a conveyor and crusher, an inlet region to the conveyor and crusher adapted to receive ash from the combustion equipment located upstream thereof, an outlet region from the conveyor and crusher for the discharge of ash, a hopper having an inlet means at the base thereof registering with the outlet region of the conveyor and crusher, and outlet means of the hopper being located at the top thereof, so that in use ash within the hopper provides a seal to prevent the passage of air there through, a container enclosing the hopper and defining therein an ash receiving zone, and a pneumatic extraction means associated with the ash receiving zone.

2. A system according to claim 1 in which the conveyor and crusher is in the form of a screw.

3. A system according to claim 2 in which the screw is provided with short flights increasing in pitch from the inlet region towards the outlet region.

4. A system according to claim 1 in whch the conveyor and crusher is orientated in an inclined mode.

5. A system according to claim 1 in which the hopper is at an elevated level above the base of the container.

6. A system according to claim 1 in which the container base has sloping walls to define a trough-like configuration.

7. A system according to claim 1 in which the pneumatic extraction means includes a suction nozzle extending into the ash receiving zone, and a vacuum generating unit connected to the suction nozzle.

8. A system according to claim 7 in which the suction nozzle comprises an outer tube terminating within the ash receiving zone and which passes through the top of the container and is open to atmosphere, and an inner tube arranged concentrically within the outer tube defining an annular passage means therebetween, the inner tube protruding beyond the end of the outer tube in the ash receiving zone.

9. A system according to claim 8 in which the inner tube terminates beyond the outer tube externally of the container and is connected by a conduit to the vacuum generating unit.

10. A system according to claim 7 in which the container has a sloping base wall and the suction nozzle is orientated adjacent said sloping wall, the nozzle being spaced from the base apex of the container to define an entrainment zone.

11. A system according to claim 10 in which the suction nozzle comprises a rectangular-sectioned air passage means, a rectangular sectioned suction passage means, and a partition dividing said passage means from one another, the air passage means being open to atmosphere and the suction passage means being connected to the vacuum generating unit.

12. A system according to claim 7 in which an ash depository is incorporated in the vacuum generating unit.

13. A system according to claim 1 in which the conveyor and crusher is in the form of a screw housed within a casing, an aperture means is provided in the casing in the vicinity of the outlet region of the conveyor and crusher, the screw is relieved in the vicinity of the aperture means, and a bar is affixed to the shaft of the screw longitudinally thereof at a location corresponding to that of the aperture.

14. Combustion equipment including a housing defining a combustion zone therewithin, a combustion means located within the combustion zone, a conveyor and crusher for carrying ash away from the combustion zone, an inlet region to the conveyor and crusher positioned to receive ash from the combustion means, an outlet region from the conveyor and crusher for the discharge of ash, a hopper having an inlet at the base thereof registering with the outlet region of the conveyor and crusher an outlet for hopper at the top thereof, a container enclosing the hopper and defining therein an ash receiving zone, and a pneumatic extraction means associated with the ash receiving zone.

* * * * *